US005106264A

United States Patent [19]

Gros

[11] Patent Number: 5,106,264

[45] Date of Patent: * Apr. 21, 1992

[54] SYSTEM FOR SUPPORTING THE ROTOR OF AN AXIAL EXHAUST TURBINE WITH THE EXHAUST END BEARING BEING INTEGRATED IN THE FOUNDATION

[75] Inventor: Jean-Pierre Gros, Villemomble, France

[73] Assignee: GEC ALSTHOM SA, Paris, France

[ * ] Notice: The portion of the term of this patent subsequent to Apr. 28, 2009 has been disclaimed.

[21] Appl. No.: 515,961

[22] Filed: Apr. 27, 1990

[30] Foreign Application Priority Data

Apr. 28, 1989 [FR] France ..... 89 05701

[51] Int. Cl.[5] ..... F01D 25/00; F01D 1/00

[52] U.S. Cl. ..... 415/213.1; 415/220

[58] Field of Search ..... 415/213.1, 220, 221, 415/222, 223, 182.1, 170.1, 174.2; 417/355, 356, 360; 403/355, 356; 60/692, 693

[56] References Cited

U.S. PATENT DOCUMENTS 1,369,668 2/1921 Junggren ..... 415/213.1
3,881,843 5/1975 Meylan ..... 415/213.1
4,050,660 9/1977 Eggmann et al. ..... 415/213.1
4,076,452 2/1978 Hartmann .
4,102,599 7/1978 Ziegler ..... 415/221
4,478,551 10/1984 Honeycutt, Jr. et al. .

FOREIGN PATENT DOCUMENTS 1093144 11/1960 Fed. Rep. of Germany .
3243659 7/1983 Fed. Rep. of Germany .
1130410 2/1957 France .
2267455 11/1975 France .

*Primary Examiner*—Edward K. Look
*Assistant Examiner*—Hoang Nguyen
*Attorney, Agent, or Firm*—Sughrue, Mion, Zinn Macpeak & Seas

[57] ABSTRACT

The bearing supporting the rotor has its stiffness increased by being connected directly to a foundation, thereby providing better behavior for the bearing in the event of a major accident (e.g. the loss of one of the blades in the last, or lowest presssure stage). In addition, by separating the bearing function from the stator exhaust end function, there is no danger of any rotor out-of-balance forces exciting resonance in the stator structure.

7 Claims, 3 Drawing Sheets

SYSTEM FOR SUPPORTING THE ROTOR OF AN AXIAL EXHAUST TURBINE WITH THE EXHAUST END BEARING BEING INTEGRATED IN THE FOUNDATION

In a turbine, or a portion of a turbine having axial exhaust, one of the rotor-supporting bearings is integrated in the exhaust endpiece.

BACKGROUND OF THE INVENTION

This bearing is held in place by means of tie rods judiciously disposed in the exhaust endpiece and conveying both normal and accidental forces from the rotor to supporting lugs and to transverse stator centering means, the lugs and the stator transverse centering means bearing against a bed plate.

This constructional disposition allows a degree of weakness to appear. Proper dynamic behavior of the rotor and rotor safety relative to accidental large out-of-balance forces require the bearing to have a high degree of stiffness which is difficult to obtain using a system of tie rods.

In addition, each azimuth corresponds to a different stiffness and this makes it more difficult to support a line of shafts whenever large accidental dynamic out-of-balance forces occur.

All of the forces pass through the bearing or the clamp, the tie rods, the supporting lugs, the stator transverse centering means, and the bed plate.

In addition, the constant increase in the size of exhaust sections is giving rise to dynamic forces of ever increasing magnitude in stators of even bigger sizes.

Document FR-A 75 10810 teaches a gas turbine installation in which the bearing is held by two poles connected to the bed plate.

Such an installation will have poor dynamic behavior since forces are compensated in the vertical direction only, while large forces in the horizontal direction will give rise to major deformation of the structure.

Finally, the poles are long and have insufficient stiffness to withstand large out-of-balance forces.

One of the aims of the support system of the invention is to increase the stiffness of the bearing supporting the rotor and to provide proper support for the bearing against major accidents (e.g. the loss of one of the last low pressure (LP) blades) under the best conditions possible.

SUMMARY OF THE INVENTION

The present invention provides a support system for supporting an axial exhaust turbine on a concrete bed plate wherein the exhaust is provided with lugs resting on concrete stands integral with the bed plate, wherein the exhaust is transversely centered by centering means bearing against the bed plate, the inside of said exhaust including a bearing supporting the turbine rotor, the said bearing being supported by tie rods radiating from the bearing, the support system including a wall integral with the bed plate and having a semi-circular opening in which the bottom portion of the exhaust is received, and the tie rods passing through the wall of the exhaust with their ends being anchored in the wall around the opening.

It may be observed that by taking the bearing support function away from the stator, out-of-balance effects of the rotor cannot excite resonance in the stator structure.

BRIEF DESCRIPTION OF THE DRAWINGS

An embodiment of the invention is described by way of example with reference to the accompanying drawings, in which.

DETAILED DESCRIPTION

Figure 1:
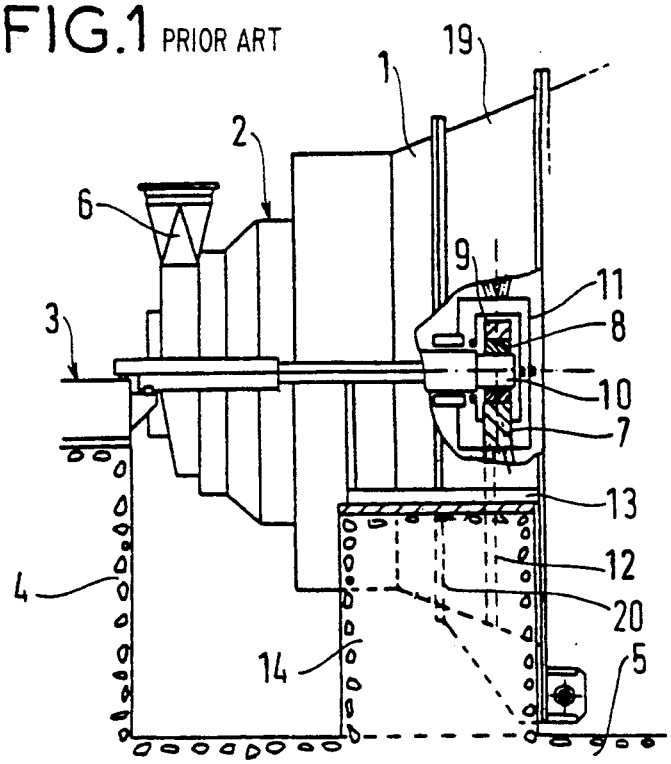
FIG.1 PRIOR ART
FIGS. 1 and 2 are respectively a side view and an end view of a prior art system for supporting the rotor of an axial exhaust turbine.
Figure 2:
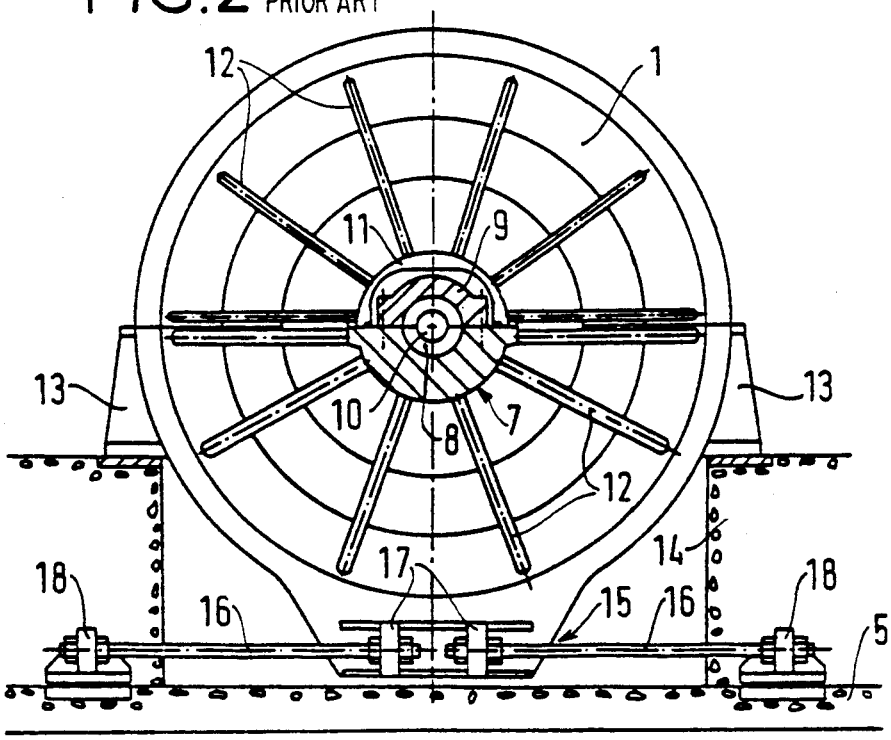
FIG.2 PRIOR ART
Figure 3:
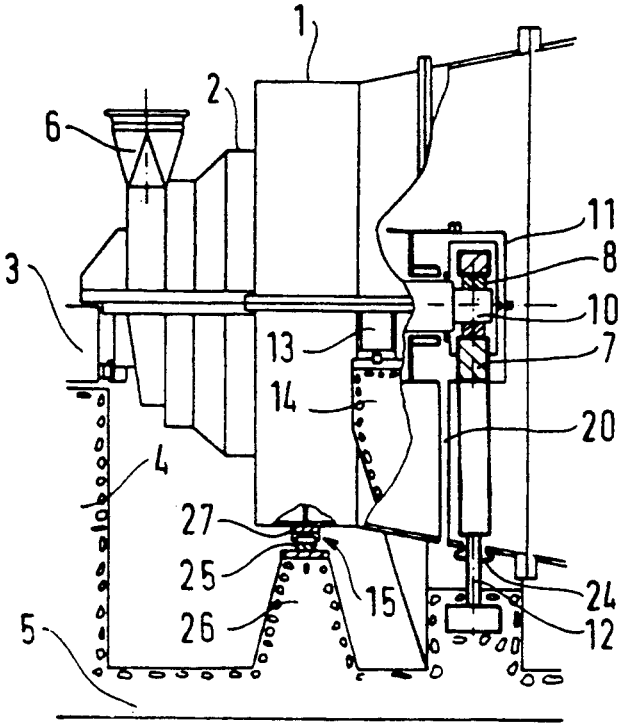
FIGS. 3 and 4 are respectively a side view and an end view of a rotor support system in accordance with the invention.
Figure 4:
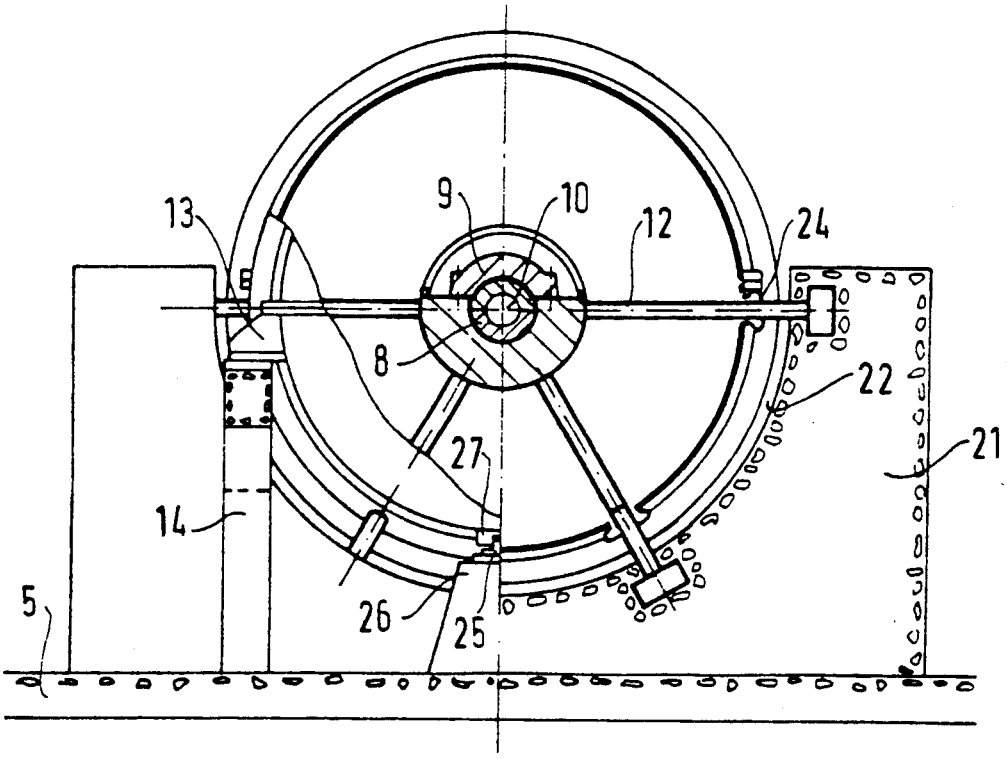
Figure 5:
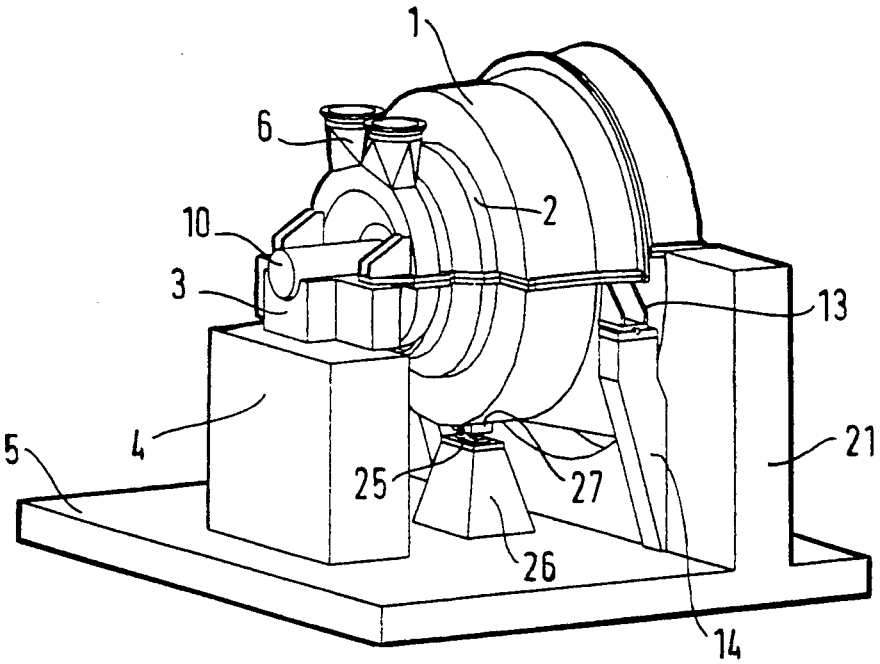
FIGS. 5 and 6 are perspective views of the rotor support system of FIGS. 3 and 4 seen from its admission end and from its exhaust end.
Figure 6:
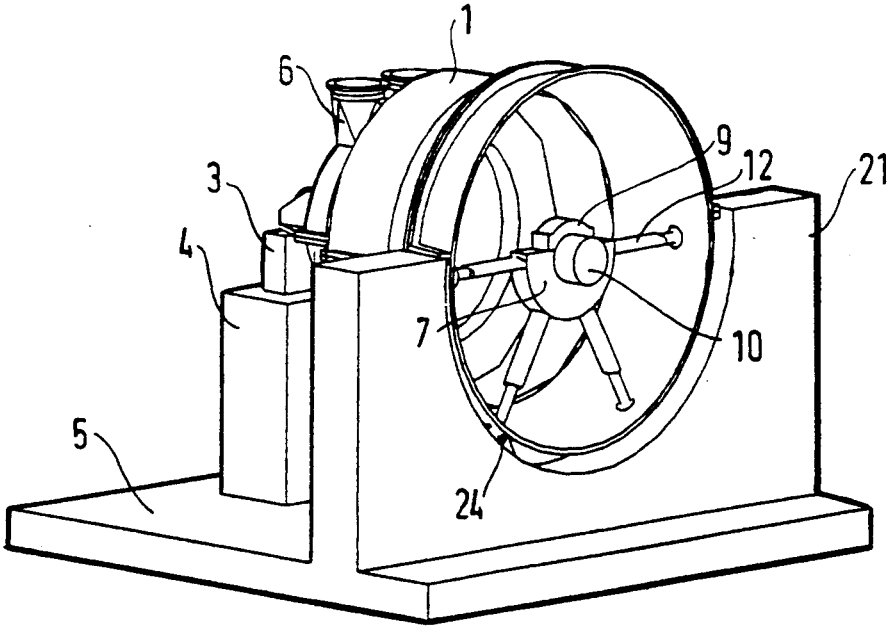

FIGS. 1 and 2 show a prior art turbine having an axial exhaust 1 forming a portion of its stator 2. The turbine includes a bearing 3 supported by a concrete stand 4 forming an admission end (6) portion of a concrete bed plate 5, and also having a bearing 7 at its exhaust end 1.

The bearing 7 comprises a shell 8 and a clamp 9 supporting the rotor 10, together with a steam shroud 11. The shroud 11 provides sealing between the steam and atmospheric pressure with which it is connected via a duct 20.

The bearing 7 is supported by tie rods 12 whose ends are fixed to the wall of the exhaust 1.

The exhaust 1 is provided with two side lugs 13 which stand on concrete stands 14 fixed to the bed plate 5.

A transverse centering device 15 is situated at the bottom of the exhaust. The device 15 includes two horizontal bars 16 each bolted at one end to a fastener 17 fixed to the bottom of the exhaust, and at the other end to a fastener 18 fixed to the concrete bed plate 5.

In order to facilitate access to the bearing 7 without it being necessary to disassemble the top portion of the stator 2, the exhaust 1 includes a removable half-part 19 which is held in place by two vertically extending half-flanges.

Both normal and accidental forces on the rotor 10 are conveyed by the tie rods 12 to the wall of the exhaust which in turn conveys them to the lugs 13 or to the centering device 15.

In the event of a large accidental out-of-balance force occurring in the prior art support system, there is a danger of the bearing 7 being damaged and of the support system itself being damaged, particularly when the parts concerned are very large in size.

In addition, the tie rods 12 distributed around the entire circumference inside the exhaust give rise to a relatively large amount of headloss.

The support system of the invention is shown in FIGS. 3 to 6. Portions which are similar to those of the prior art system are given the same references.

The turbine rotor 10 is supported by two bearings 3 and 7, one of them being situated at the admission end 6 and the other inside the axial exhaust 1.

The bearing 3 is supported by a concrete stand 4 on the concrete bed plate 5.

The bearing 7 includes a shell 8 having a clamp 9 fixed thereon and a steam shroud 11.

The shroud 11 is kept at atmospheric pressure by means of a duct 20.

According to the invention, a vertical concrete wall 21 is provided integral with the bed plate 5 and including a semi-circular recess opening 22 in which the bottom portion of the exhaust 1 is received.

The bearing 7 is supported by four radiating tie rods 12 situation in a vertical plane perpendicular to the axis of the rotor. Two of the tie rods are horizontal, and the other two are downwardly oblique and disposed at angles of 60° relative to the adjacent tie rods.

The tie rods 12 have their opposite ends anchored in the thickness of the wall 21 around the semi-circular opening 22.

Each of the tie rods 12 is provided with a sealing bellows 24 where is passes through the wall of the exhaust 1.

The bottom portion of the exhaust 1 is fixed to the stator 12 and is provided with two side lugs 13 resting on respective concrete stands 14 integral with the bed plate 5.

The stator centering device 15 is situated adjacent to the exhaust 1. It comprises a key 25 mounted on a concrete stand 26 integral with the bed plate 5, said key 25 being imprisoned in a slideway 27 extending parallel to the axis of the turbine and integral with the exhaust.

The stands 4, 14, and 26, and the wall 21 are preferably made of concrete and are directly integrated in the bed plate 5, constituting, together therewith, a massive anchor block. Naturally, it will be possible to make these stands using a steel structure.

Bearing forces are not longer transmitted via the stator 2 and the exhaust 1 since the tie rods 12 are received in the concrete wall 21. The system of the invention is particularly simple and is thus capable of withstanding very large accidental out-of-balance forces while conserving integrity of rotor support.

The number of tie rods 12 required for transmitting these forces is much smaller than would be required using the prior art system. Exhaust headlosses are thus minimized.

Finally, since the bearing 7 does not transmit forces to the exhaust 1, the strands 14 supporting the side lugs 13 may be much lighter in construction and the centering device 15 may be a simple key and keyway device.

Access to the exhaust end bearing is particularly easy and is done by removing the top half-portion 19 of the exhaust 1, with the bearing 7 which is directly anchored to the bed plate remaining in place.

I claim:

1. In a support system for supporting a steam turbine having an axial exhaust on a concrete bed plate wherein said exhaust is provided with lugs resting on concrete stands integral with the bed plate, wherein the exhaust is transversely centered by centering means bearing against the bed plate, the inside of said exhaust including a bearing supporting the turbine rotor, said bearing being supported by a plurality of tie rods fixed to and radiating from the bearing, the improvement comprising an upright wall integral with the bed plate having an upwardly open, semi-circular recess facing and receiving a bottom portion of the exhaust, and said tie rods having ends thereof passing through a wall of the exhaust with said ends being anchored in the upright wall around the recess.

2. A support system according to claim 1, wherein the tie rods are regularly distributed around the bearing.

3. A support system according to claim 2, wherein said tie rods include at least two horizontal tie rods and at least two downwardly oblique tie rods spaced apart at 60° intervals relative to adjacent horizontal tie rods.

4. A support system according to claim 1, wherein the points where the tie rods pass through the wall of the exhaust are provided with expansion sealing bellows.

5. A support system according to claim 1, wherein the exhaust is centered transversely on said concrete bed plate by means of a key and keyway device.

6. A support system according to claim 1, wherein the upright wall is made of concrete.

7. A support system according to claim 1, including a steam shroud fixed to the bearing to provide sealing between the exhaust steam and atmospheric pressure.

* * * * *